United States Patent [19]

Shea, Jr. et al.

[11] Patent Number: 4,464,874

[45] Date of Patent: Aug. 14, 1984

[54] WINDOW UNIT

[75] Inventors: John R. Shea, Jr., Baltimore, Md.; A. Risher Hall, Vincentown; Robert C. Hordis, Beverly, both of N.J.

[73] Assignee: Hordis Brothers, Inc., Pennsauken, N.J.

[21] Appl. No.: 439,064

[22] Filed: Nov. 3, 1982

[51] Int. Cl.[3] ..... E06B 3/24

[52] U.S. Cl. ..... 52/398; 52/304; 52/788

[58] Field of Search ..... 52/395, 398, 172, 304, 52/788, 790

[56] References Cited

U.S. PATENT DOCUMENTS

| | | | |
|---|---|---|---|
| 2,303,149 | 11/1942 | Verhagen | 189/64 |
| 2,342,758 | 2/1944 | Saunders et al. | 52/398 |
| 2,367,035 | 1/1945 | McConnell et al. | 52/398 X |
| 2,416,269 | 2/1947 | Paul | 52/398 |
| 2,525,717 | 10/1950 | Ottenheimer | 20/56.5 |
| 3,434,258 | 3/1969 | Leurent | 52/397 |
| 3,875,706 | 4/1975 | Okawa | 52/172 |
| 3,881,290 | 5/1975 | Bouchey | 52/398 |
| 4,149,348 | 4/1979 | Pyzewski | 52/172 |
| 4,266,487 | 5/1981 | Marulic et al. | 52/398 X |

FOREIGN PATENT DOCUMENTS

| | | | |
|---|---|---|---|
| 1534839 | 8/1969 | Fed. Rep. of Germany | 52/398 |

*Primary Examiner*—J. Karl Bell

*Attorney, Agent, or Firm*—John F. A. Earley

[57] ABSTRACT

A multiple pane glass window unit comprising an outboard glass sheet spaced apart from an inboard glass sheet, spacer members positioned between and connected to the horizontal and vertical portions of the glass sheets to space them apart, said spacer members including a horizontal head spacer member connected to a horizontal sill spacer member by a pair of spaced-apart vertical side spacer members, said vertical side spacer members spacing apart the glass sheets and stiffening and supporting the side edge portions of the glass sheets against pressures of wind and rain and the elements, and factory-affixed gasket members attached to the vertical edges of the side spacer members for sealing the vertical space between side-abutting window units, said gasket members being adapted to be compressed between the sides of side-abutting window units, said side spacer members including a side spacer member that is U-shaped in cross-section with the legs of the U facing sideways from the window unit, a foam spacer tape adhered to the edge portions of the legs of the side spacer member and to the side edge portion of the outboard glass sheet, and adhesive layers sealing the side spacer legs to the interior surface of the glass sheets, whereby the sides of abutting window units may be sealed by placing the sides close enough together that they compress the foam spacer tape between them, and whereby the window units may be installed from the inside of the building. In the space formed between the vertical edges on the inside glass of two-abutting units and the inside edges of the factory-affixed gasket members silicone caulking is applied at the time of installation to completely seal the vertical joint between units.

5 Claims, 7 Drawing Figures

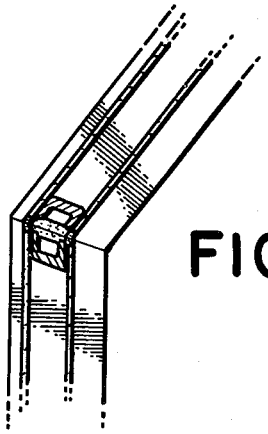
FIG. 4
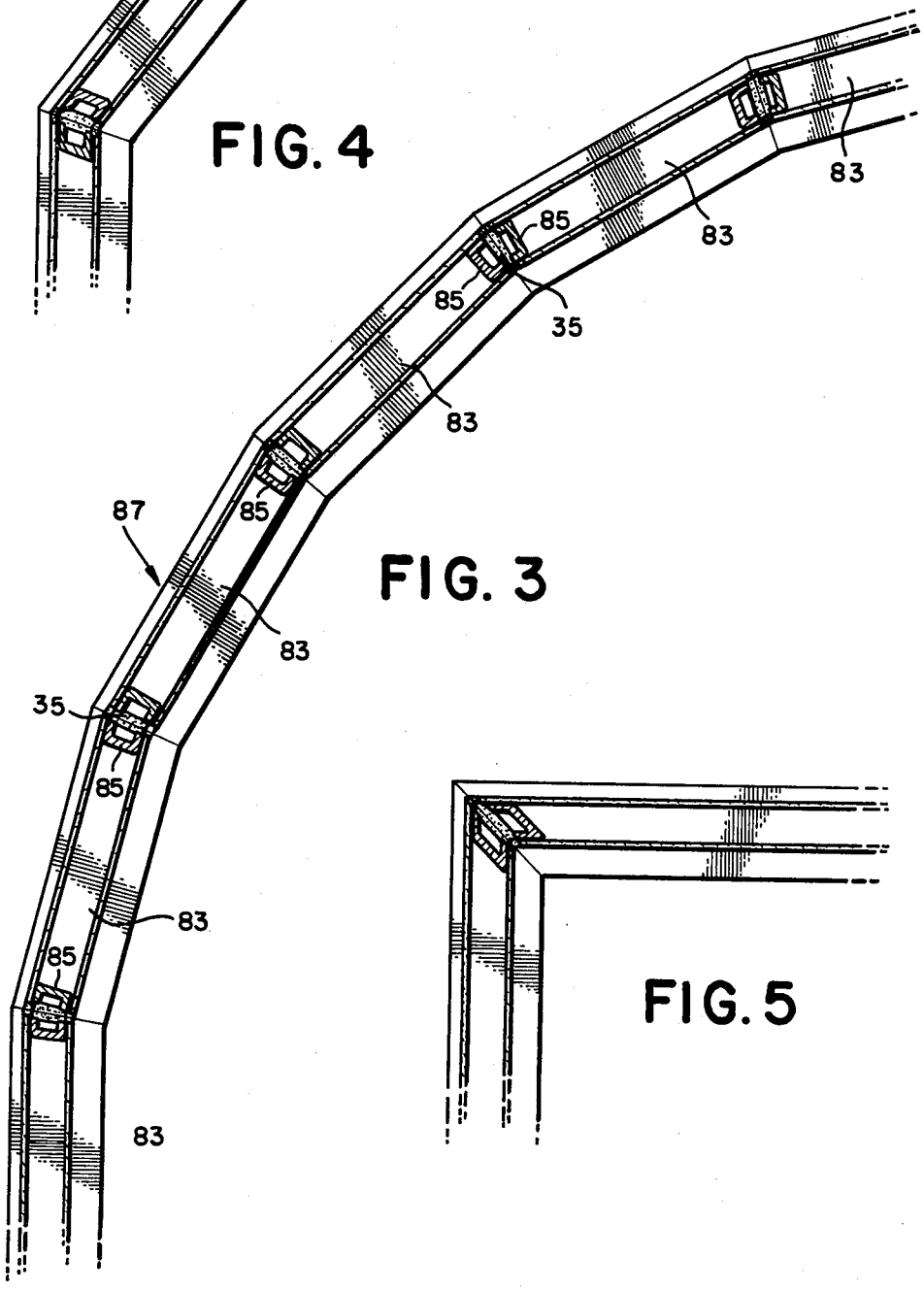
FIG. 3
FIG. 5

WINDOW UNIT

BACKGROUND OF THE INVENTION

1. Field of the Invention

This invention relates specifically to multiple pane window units, and more specifically to multiple pane window units installed in a fashion known as "butt-glazed."

2. Description of the Prior Art

Prior art window units of this type are installed from the outside of the building and require the use of a temporary fastening method which has to remain in place until the adhesive material around the window unit has set properly which temporary fastening method is then removed, and which units also require a permanent upright stiffener on the inside of the building which stiffener is not desirable because it tends to obscure the view from the inside of the building and to prohibit placing furniture or drapes close to the windows.

Conventional multiple pane window units which are glazed in a conventional fashion are supported against wind load forces by clamping them into a window frame. Such windows are provided with relatively weak spacers between the panes of glass.

However, in butt glazing the vertical edges of the window unit are not supported in a window frame, and support is given to the vertical edges of the window unit by an interior stiffener. To install the conventional butt-glazed window unit, it is clamped in place by a temporary fastening method while the inside structrual silicone adhesive, which is applied to the inner face of the units adjacent to the vertical edges, is curing. After curing, the structural silicone adhesive bonds the vertical stiffener to the window units, thus achieving the necessary structural strength.

Moreover, if a butt-glazed window unit should break and have to be replaced, the replacement window unit must also be installed from the outside of the building in the same manner, and this presents problems and is expensive.

Another problem in the art is how to arrange a series of butt-glazed window units to form the cords of a curve to conform to the curved contours of a modern building.

Conventionally, the series of window units are set in the appropriate positions so as to form the cords of a curve, but the joints between abutting window units are large and vary in size, and such joints give an uneven appearance that is undesirable. Also, such joints are difficult to seal, they obscure vision, and in cases where the outboard pane is wider than the inboard pane, the vertical edges of the outboard pane are exposed to damage in handling and in installing.

SUMMARY OF THE INVENTION

It is an object of this invention to provide a multiple pane, butt-glazed, window unit which may be installed easily from the interior of a building, and which does not require a permanent upright stiffener on the inside of the building, nor does it require the utilization of a temporary means to hold the window unit in place while the structural silicone adhesive joining the abutting units and stiffener is curing.

It is another object of the invention to permit installation of the window units in a series of cords to conform to the curved exterior of the building, without unsightly wide and non-uniform gaps and joints between window units.

It is another object of the invention to allow for installation of the units in such a way that replacement window units may be installed from the inside of the building.

In a continuous series of window units which are positioned so as to conform with the curvature of a building, it is an object to keep the vertical joint between abutting window units as small and as uniform as possible so as to give the overall effect of a continuous run of glass.

BRIEF DESCRIPTION OF THE DRAWINGS

FIG. 3 is a view in horizontal section showing a series of inventive window units conforming to the curved exterior of a building;

FIG. 4 is a view in horizontal section showing abutting window units at a 135° corner;

FIG. 5 is a view in horizontal section showing abutting window units at a 90° corner;

DETAILED DESCRIPTION

Figure 1:
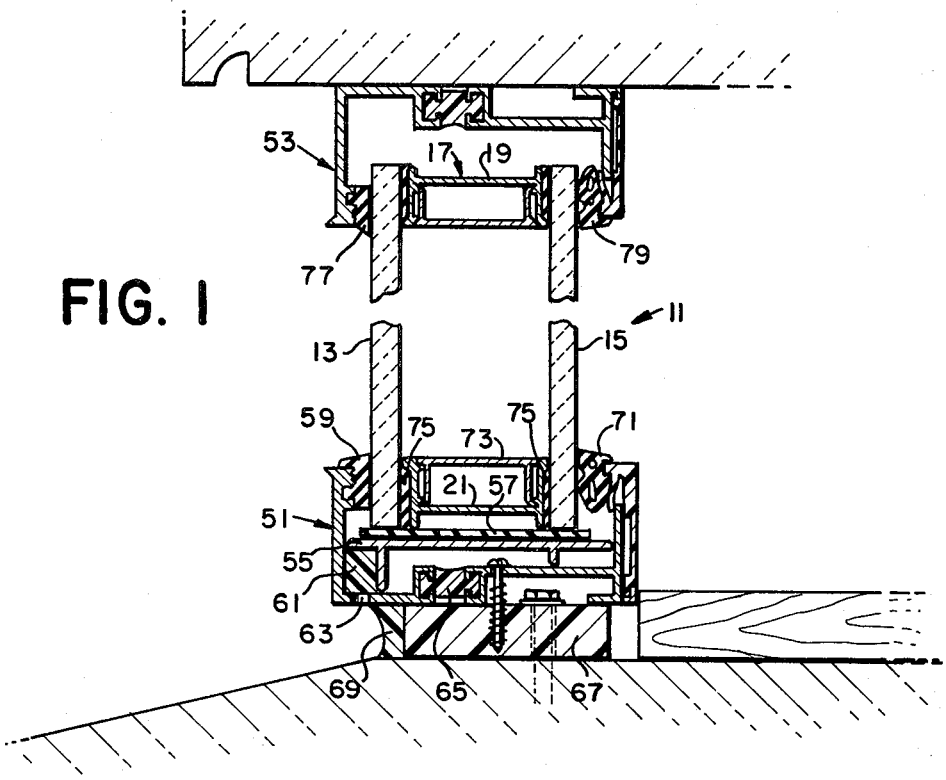
FIG. 1 is a view in vertical section of a window unit constructed in accordance with this invention.

Turning now to the drawings, there is shown a multiple pane glass window unit 11 which comprises an outboard glass sheet 13 spaced apart from an inboard glass sheet 15, and spacer means 17 positioned between and connected to the horizontal and vertical edge portions of the glass sheets 13,15 to space them apart.

Spacer means 17 includes a horizontal head spacer member 19 which is connected to a horizontal sill spacer member 21 by a pair of spaced-apart vertical side spacer means 23, 24 which serve to space apart the glass sheets 13,15 and to stiffen and support the side edge portions of the glass sheets against pressures of wind and rain and the elements.

A factory-affixed gasket means 27 is attached to the vertical edges of the side spacer means 23,24 to seal the vertical space between side-abutting window units 11. Gasket means 27 are adapted to be compressed between the sides of side-abutting window units, and this arrangement permits installation of the window units from the inside of the building.

Each side spacer means 23,24 includes a side spacer member 29 that is U-shaped in cross-section with the legs 31,32 connected together by a base portion 33 and with the legs 31,32 facing sideways from the window unit 11.

A foam spacer tape 35 is factory-adhered by an adhesive layer 37 to the edge portions 39,40 of the side spacer member 29 and also to the side edge portion 41 of outboard glass sheet 13.

Means are provided for sealing the side spacer legs 31,32 to the interior surface of the glass sheets and include a layer 43 of butyl sealant, and a layer 45 of structural silicone adhesive.

A butyl seal is also provided between the horizontal spacer members 19,21, and the side spacer members 29.

A layer 47 of adhesive may be applied between abutting gaskets 35 and may be applied from the inside of the building at the job.

Figure 2:
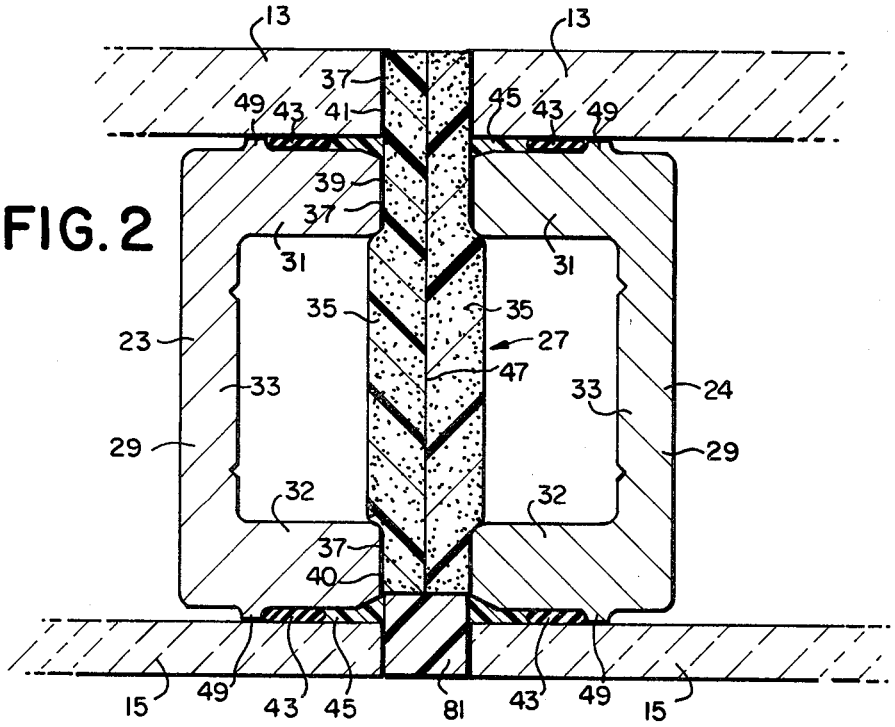
FIG. 2 is a view in horizontal section of side-abutting window units constructed in accordance with this invention.

Accordingly, the sides of abutting window units 11 may be sealed by placing the sides close enough together that they compress the foam spacer tape 35 between them in the manner shown in FIG. 2.

Shoulders 49 on the legs 31,32 of the side spacer members 29 tend to dress up the butyl line of layer 43.

Referring to FIG. 1 more specifically, window unit 11 is supported between sill perimeter frame 51 and head perimeter frame 53, with the bottom of the window unit 11 resting on vinyl rubber cap 57 of an extruded aluminum setting chair 55. A weather seal 59 made of extruded neoprene rubber is positioned between the outboard pane 13 and sill frame 51, and an open cell reticulated foam airstop 61 is positioned just above a weep slot 63 that permits water to drain out of the window unit 11.

A thermal barrier 65 is provided and the sill frame 51 is attached to a block 67 that has an outer layer 69 of a sealant.

A wedge 71 of extruded solid neoprene rubber is positioned between inboard glass sheet 15 and the sill frame 51, and serves to push the window unit 11 against weather seal 59.

Sill spacer members 19 and 21 provide space for a dessicant to remove water vapor which may penetrate the sealed air space between the glass sheets. A cover 73 snaps into spacer members 19 and 21, and a silicone and butyl seal 75 is provided between the glass sheets and the spacer members 19 and 21.

The upper edge portions of glass window unit 11 are supported by head frame 53 between seals 77 and 79.

Referring now more specifically to FIG. 2, gaskets 35 are flush with the outer edge of the outboard sheet 13 of glass but are short of the inboard glass sheets 15 and thereby form a channel 81 which may be filled with caulking at the job site.

Side spacer members are heavy and strong, and are preferably made of aluminum or stainless steel. They are two inches wide from the outer surface of one leg to the outer surface of the other, and provide a two inch air space between the glass sheets.

Referring now to FIGS. 3–5, a series of multiple pane glass window units 83 are shown having side spacer members 85 that are formed to an angle to allow the series of window units 83 to form cords of a curve and to abut at an angle to conform to the curved contours 87 of a building and yet provide a uniform spacing between the window units 83 instead of the unsightly large and non-uniform spacing between conventional window units. It is to be noted that the outboard glass sheets of mitered window units 83 are larger in the horizontal direction than are the inboard glass sheets. Ordinarily, this could cause a problem in handling and shipping and installing because of possible chipping and breakage, but these outboard glass sheets are protected by the foam spacer tapes or gaskets, and do not project or extend beyond the spacers 85.

Figure 6:
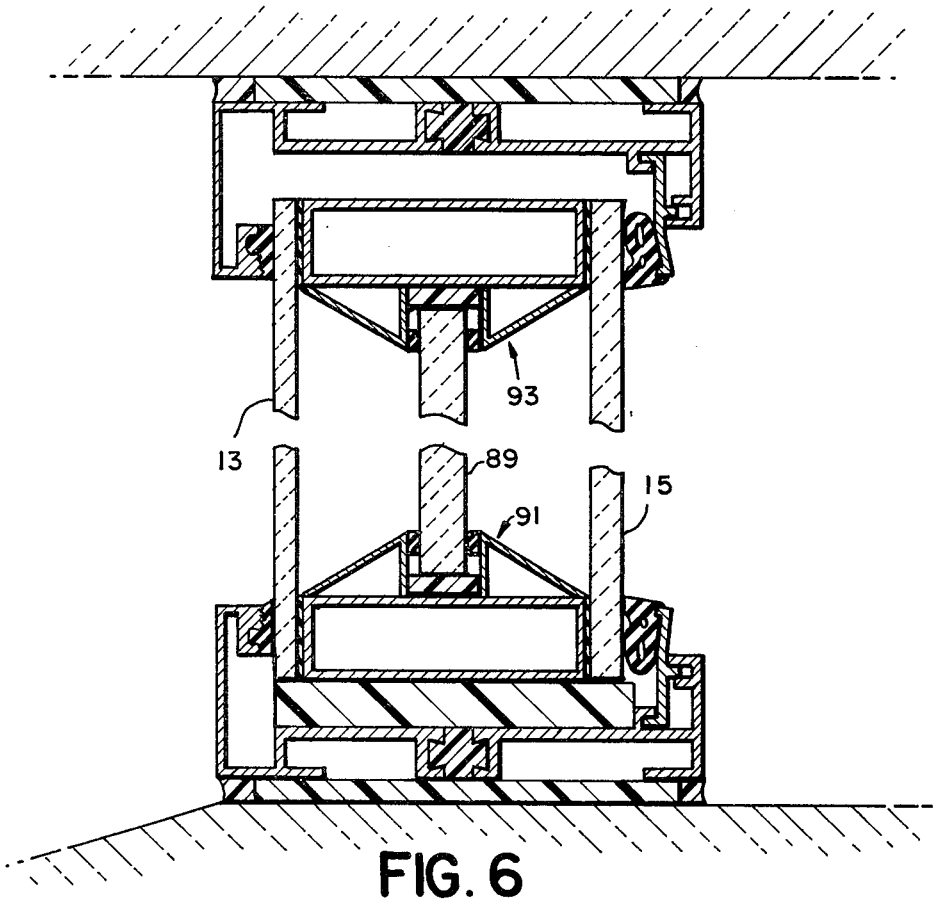
FIG. 6 is a view in vertical section of a triple-pane window unit constructed in accordance with this invention.
Figure 7:
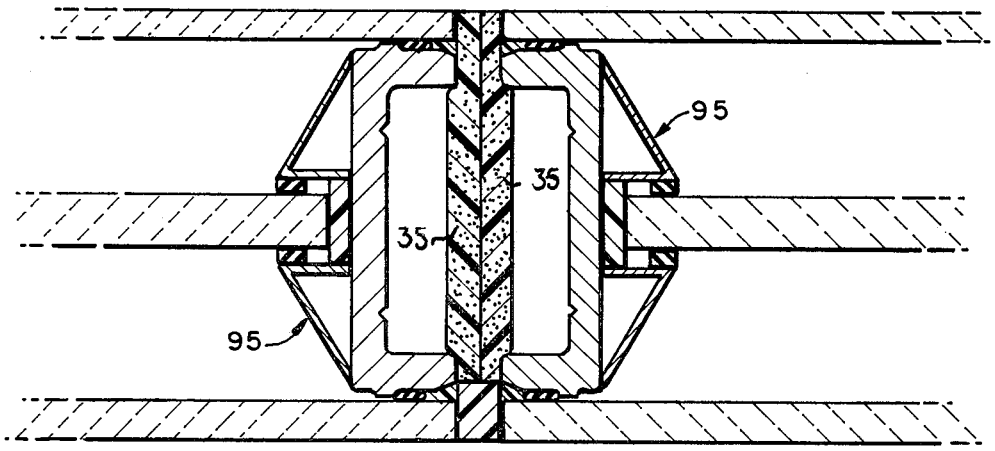
FIG. 7 is a view in horizontal section showing side-abutting window units of FIG. 6.

Referring now more specifically to FIGS. 6 and 7, a middle glass sheet 89 is positioned between outboard glass sheet 13 and inboard glass sheet 15, and is supported at the bottom by sill spacer means 91, at the top by head spacer means 93, and at the sides by side spacer means 95.

In operation, the multiple pane glass window units are erected and set into place from the inside of the building, and the abutting window units press against each other to compress the foam spacer tapes or gaskets 35 between them. The spaces between window units are neat and uniform and attractive in appearance, there is no necessity to use an outside temporary bracket or clamping means, and there is no necessity to use an inside upright permanent stiffener. There is no necessity to apply an exterior vertical joint seal from the outside of this building.

In prior art units, the inside structural silicone adhesive seal between the permanent inside supporting stiffener and the inboard surface of the inboard glass sheet must cure and seal properly, or the seal may develop interior cracks under minor wind loads as the silicone is curing. This would later cause trouble, having weakened the structural supporting properties of the silicone, and the window units would not be properly supported on the sides and could fail and even be torn from the building under negative wind loads. For example, if the wind blows on the north side of a building, the north is subjected to a positive wind load, and the south side of the building is subjected to a negative wind load which may pull the window out of the building.

Accordingly, prior art units are heavily dependent on proper installation at the job site. If the contractor skips the step of temporarily supporting the window unit sides while the silicone layer between the inside support and inside of the window unit is curing, the window may fail. An advantage of this inventive window unit is that the silicone seal 45 is factory installed and fully cured, to a point of being structurally sound when it arrives at the job site, and is not dependent on the skill or care of the installer for its structural strength.

We claim:

1. A multiple pane glass window unit comprising an outboard glass sheet spaced apart from an inboard glass sheet and having horizontal and vertical edge portions, a horizontal head spacer member connected to a horizontal sill spacer member by a pair of spaced-apart vertical side spacer and stiffener means for spacing apart the glass panes and stiffening the multiple pane glass unit, said vertical side spacer and stiffener means being positioned between and connected to the glass sheets at the vertical edge portions of the glass sheets to space them apart and protect the edge of the glass sheets from damage, said vertical side spacer and stiffener means being U-shaped with a pair of legs extending from a base portion, said vertical side spacer and stiffener means being mounted at the vertical peripheral edges of the glass sheets with the edges of said legs substantially flush with the vertical peripheral edges of the glass sheets and mounted solely within the interior of the glass sheets, and gasket means attached to the vertical edges of said legs for sealing the vertical space between side-abutting window units, said gasket means being adapted to be positioned and compressed between the vertical sides of side-abutting window units, whereby the window units may be installed from the inside of a building.

2. The glass window unit of claim 1, said gasket means including a foam spacer tape adhered to the vertical edge portions of the legs of the side spacer member and to the vertical side edge portion of the outboard glass sheet, and means sealing the side spacer legs to the interior surface of the glass sheets, whereby the sides of abutting window units may be sealed by placing the sides close enough together that they compress the foam spacer tape between them.

3. The glass window unit of claim 1, said gasket means including a vertical factory-applied foam plastic tape attached to the vertical edges of the outboard glass sheet and to the vertical edges of the legs of the side spacer members so that the gasket is flush with the outer edge of the outboard sheet of glass and is short of the inboard glass sheet to form a channel which may be caulked from the inside, a butyl seal between the outside surfaces of the spacer member legs and the interior surfaces of the glass sheets, a butyl seal between the horizontal spacer members and the side spacer members, a structural silicone seal between the outside surfaces of the spacer legs and interior surfaces of the glass sheets, and an adhesive seal between the vertical gaskets and the side spacer members.

4. The glass window unit of claim 1, the vertical side spacer and stiffener means being formed to an angle to allow a series of said window units to form chords of a curve and abut at an angle to conform to the curved contours of a building with a uniform spacing between the window units instead of unsightly large and non-uniform spacing between window units.

5. The glass window unit of claim 1, including a middle glass sheet positioned between the outboard and inboard spaced apart glass sheets, and means supporting the middle glass sheet between said outboard and inboard glass sheets.

* * * * *